US010465328B2

(12) United States Patent
Lee et al.

(10) Patent No.: US 10,465,328 B2
(45) Date of Patent: Nov. 5, 2019

(54) LAUNDRY TREATMENT APPARATUS

(71) Applicant: LG ELECTRONICS INC., Seoul (KR)

(72) Inventors: Jihong Lee, Seoul (KR); Kijung Sung, Seoul (KR)

(73) Assignee: LG Electronics Inc., Seoul (KR)

( * ) Notice: Subject to any disclaimer, the term of this patent is extended or adjusted under 35 U.S.C. 154(b) by 14 days.

(21) Appl. No.: 14/812,278

(22) Filed: Jul. 29, 2015

(65) Prior Publication Data

US 2016/0032517 A1 Feb. 4, 2016

(30) Foreign Application Priority Data

Jul. 30, 2014 (KR) ..... 10-2014-0097235

(51) Int. Cl.
*D06F 39/08* (2006.01)
*D06F 29/00* (2006.01)

(52) U.S. Cl.
CPC ..... *D06F 39/088* (2013.01); *D06F 29/00* (2013.01)

(58) Field of Classification Search
CPC ..... D06F 39/088; D06F 39/083; D06F 31/00; D06F 31/005
USPC ..... 68/12.12, 27
See application file for complete search history.

(56) References Cited

U.S. PATENT DOCUMENTS 2,209,189 A * 7/1940 Callejo ..... E03C 1/108 137/218
3,381,700 A * 5/1968 Frymark ..... A47L 15/4217 137/216
7,017,217 B2 3/2006 Johanski et al.
2009/0133198 A1* 5/2009 Lee ..... D06F 31/00 8/158
2009/0158784 A1 6/2009 Kim et al.
2010/0088828 A1 4/2010 Kim et al.
2010/0101282 A1 4/2010 Jeong et al.
2010/0107704 A1* 5/2010 Seo ..... D06F 39/02 68/17 R
2011/0041561 A1 2/2011 Apel
2011/0265524 A1 11/2011 Kim et al.
2012/0103028 A1 5/2012 Lee et al.
2014/0109323 A1 4/2014 Kim et al.

FOREIGN PATENT DOCUMENTS

CN 101652512 2/2010
CN 102216515 10/2011
CN 102454089 5/2012
CN 103687987 3/2014
EP 2063014 5/2009
(Continued)

OTHER PUBLICATIONS

Machine translation of JP 2000237497 A, dated Sep. 2000.*
(Continued)

*Primary Examiner* — Joseph L. Perrin
*Assistant Examiner* — Kevin G Lee
(74) *Attorney, Agent, or Firm* — Fish & Richardson P.C.

(57) ABSTRACT

A laundry treatment apparatus includes a tub configured to receive washing water, a drum rotatably disposed in the tub, a water supply unit configured to supply washing water to the tub, and a water discharge unit configured to discharge washing water from the tub. The water supply unit is in fluidic communication with the water discharge unit.

20 Claims, 5 Drawing Sheets

(56) References Cited

FOREIGN PATENT DOCUMENTS

| | | |
|---|---|---|
| EP | 2620536 | 7/2013 |
| JP | 2000-237497 | 9/2000 |
| JP | 2005-052627 | 3/2005 |
| KR | 101461950 | 11/2014 |
| WO | 2009134018 | 11/2009 |
| WO | 2012/150539 | 11/2012 |

OTHER PUBLICATIONS

Extended European Search Report issued in European Application No. 15178805.6 dated Oct. 28, 2015, 9 pages.
Office Action issued in Australian Application No. 2015207896 dated Mar. 4, 2016, 6 pages.
Chinese Office Action in Chinese Application No. 201510446954, dated Dec. 29, 2016, 15 pages (with English translation).
Indian Office Action in Indian Appln. No. 831KOL2015, dated Feb. 4, 2019, 7 pages (with English translation).

* cited by examiner

【fig. 1】
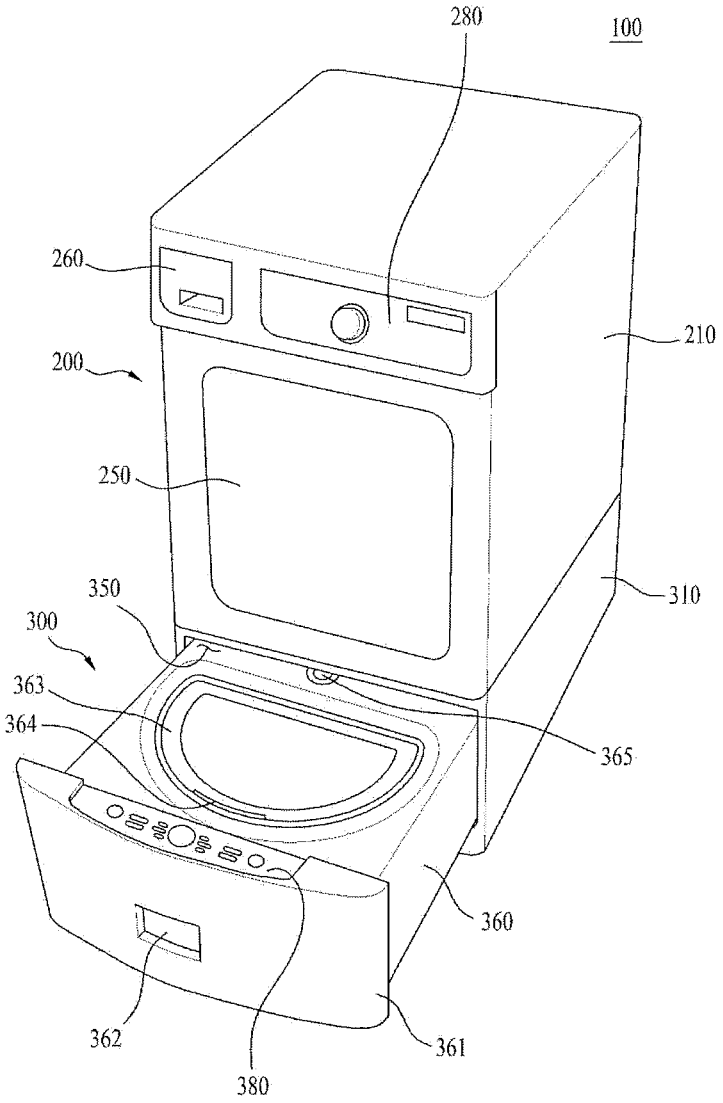

【fig. 2】
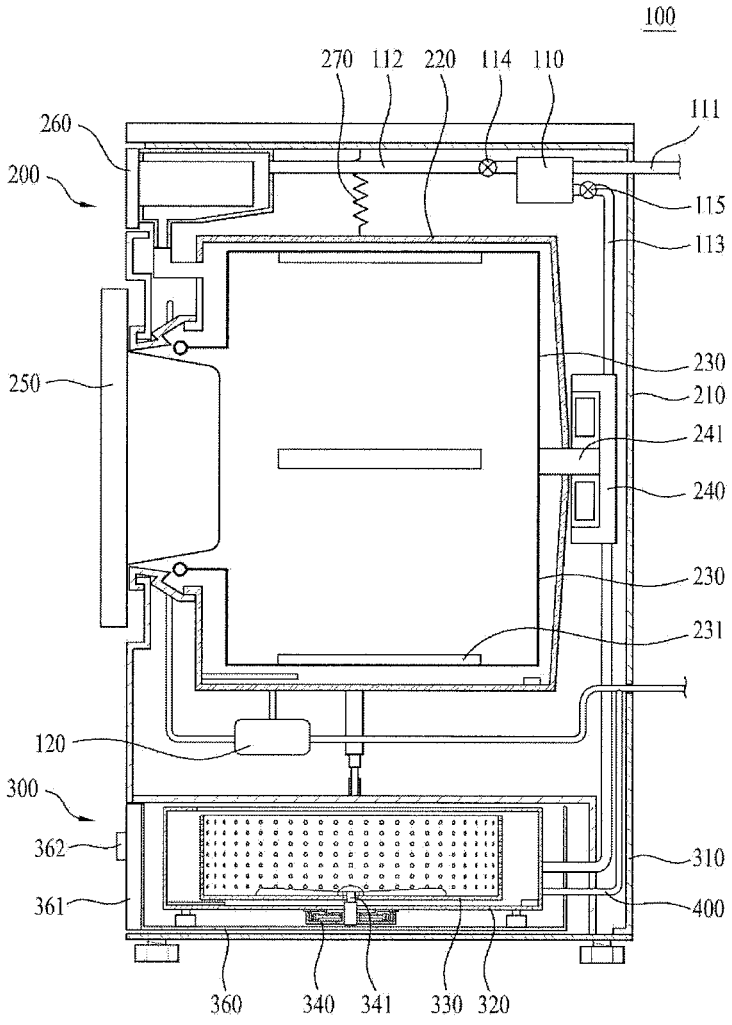

【fig. 3】
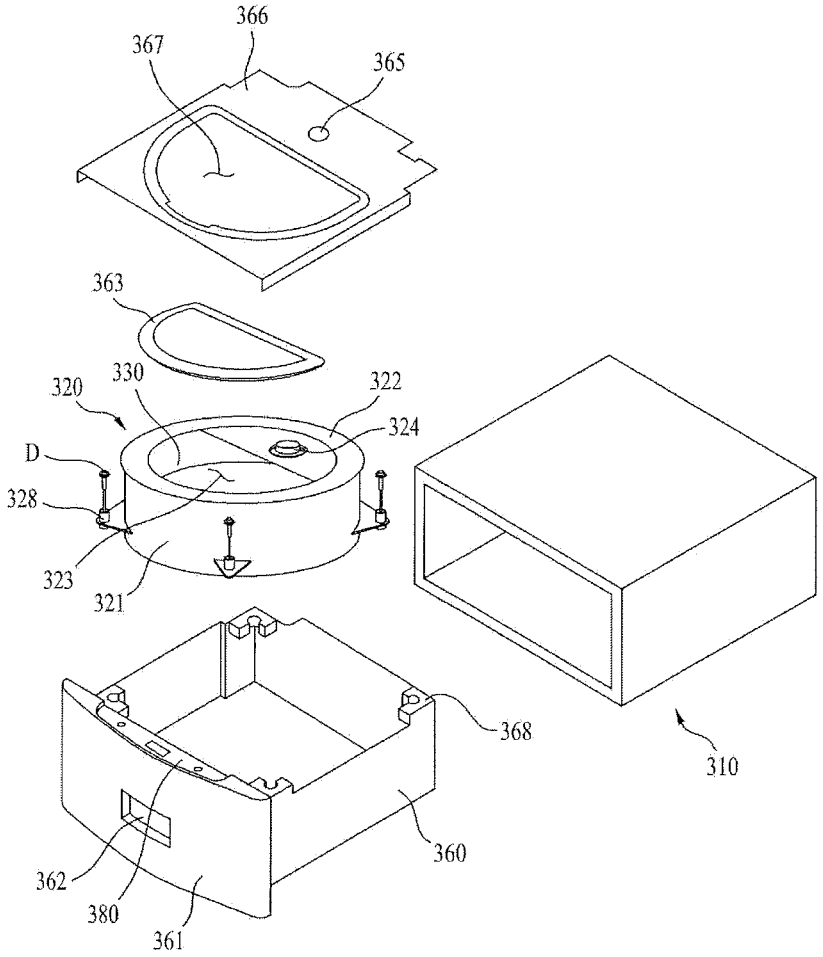

【fig. 4】
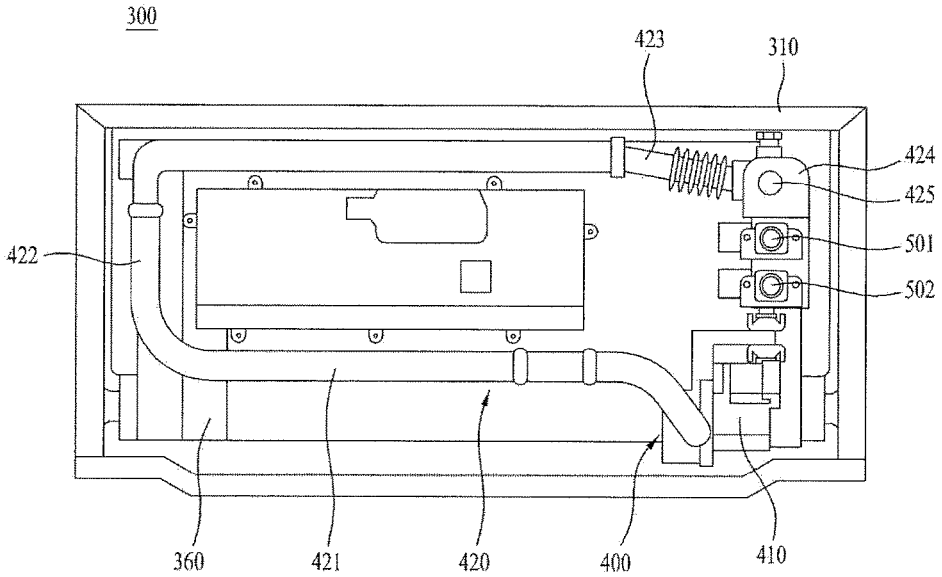
【fig. 5】
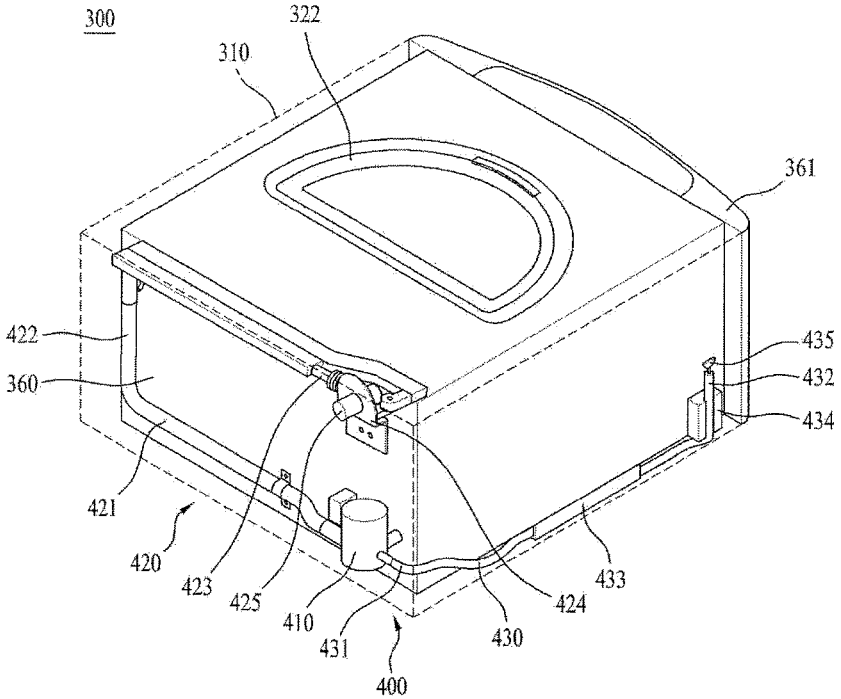

【fig. 6】
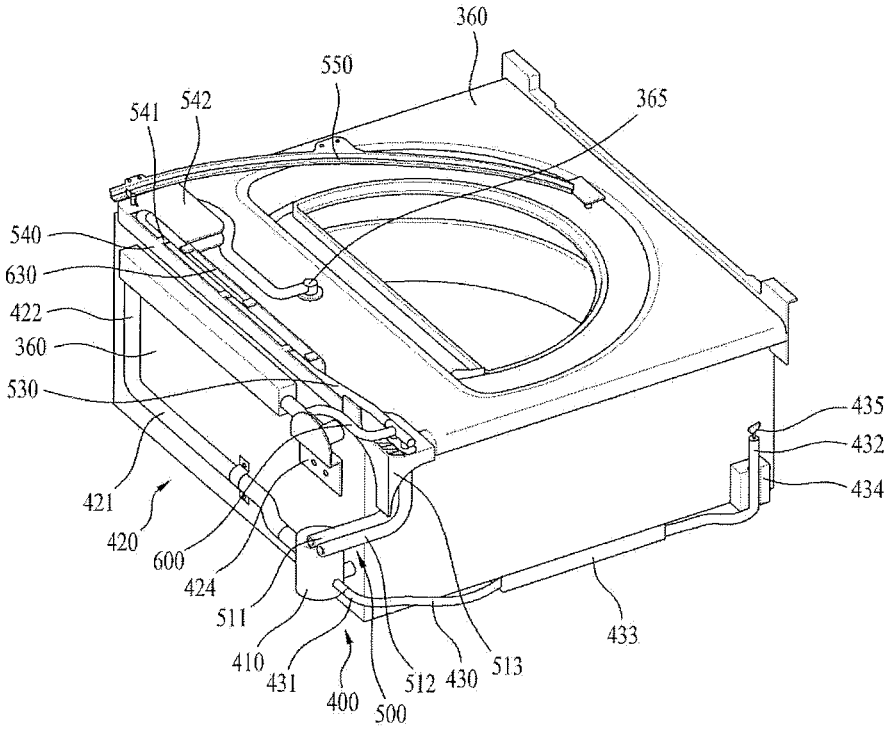
【fig. 7】
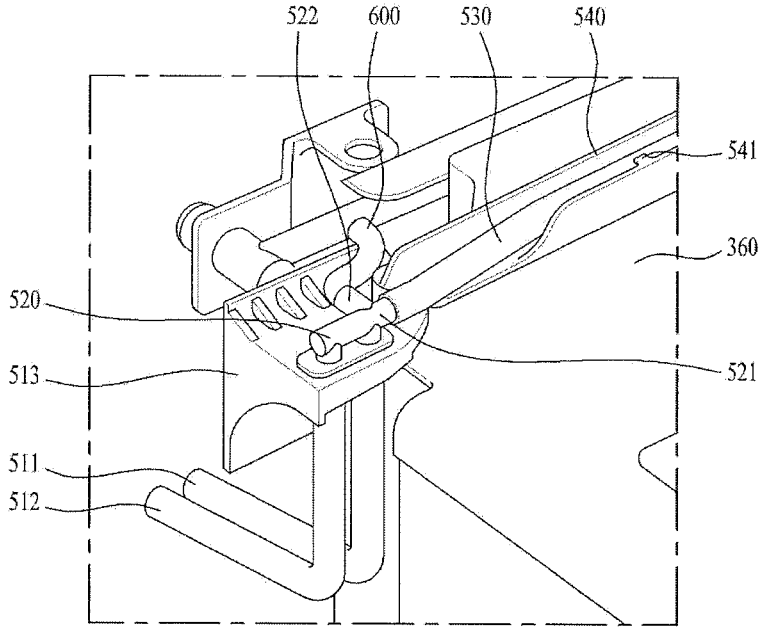

LAUNDRY TREATMENT APPARATUS

This application claims the benefit of Korean Patent Application No. 10-2014-0097235, filed on Jul. 30, 2014, which is hereby incorporated by reference as if fully set forth herein.

FIELD

The present disclosure relates to a laundry treatment apparatus, and more particularly, to a laundry treatment apparatus including a main washing apparatus and a secondary washing apparatus which is additionally provided at the main washing apparatus to treat laundry.

BACKGROUND

Generally, a laundry treatment apparatus refers to an apparatus adapted to wash laundry, an apparatus adapted to dry laundry, or an apparatus adapted to perform both washing and drying of laundry.

A front-loading laundry treatment apparatus (also called a drum washing machine) is constructed to allow laundry to be put into the apparatus from the front of the apparatus and has an introduction port through which laundry can be put into the apparatus. Since the front-loading laundry treatment apparatus has an introduction port positioned at a level lower than a user's waist, the apparatus may be inconvenient to use in that a user may have to stoop in order to put laundry into the apparatus or takes laundry out of the apparatus.

In some cases, a support platform may be additionally provided under the front-loading laundry treatment apparatus so as to raise the height of the introduction port. Such support platforms are intended, for example, to raise the height of the introduction port.

In some cases, at low ambient temperatures, when washing water and softener remain in a water supply pipe for supplying washing water and a softener supply pipe for supplying softener, the water supply pipe and the softener supply pipe may freeze and potentially rupture.

SUMMARY

According to one aspect, a laundry treatment apparatus includes a tub configured to receive washing water, a drum rotatably disposed in the tub, a water supply unit configured to supply washing water to the tub, and a water discharge unit configured to discharge washing water from the tub. The water supply unit is in fluidic communication with the water discharge unit.

Implementations according to this aspect may include one or more of the following features. For example, the water supply unit may include a supply pipe configured to supply washing water to the tub, a water supply pipe extending into the tub, and a water supply connection pipe connecting the supply pipe to the water supply pipe. The water supply connection pipe may be in fluidic communication with the water discharge unit. The supply pipe may include a cold water pipe configured to supply cold water to the tub and a hot water pipe configured to supply hot water to the tub. The water supply pipe may provide a fluidic connection between the cold water pipe and the hot water pipe, and the water supply pipe may extend into the tub from the water supply connection pipe.

In some implementations, the water discharge unit may include a water discharge pump configured to discharge washing water from the tub, and a water discharge line that has a fluidic connection to the water discharge pump and that is configured to guide washing water in the tub to an exterior of the tub. The water supply connection pipe may be in fluidic communication with the water discharge line. In some cases, the water discharge unit may further include a residual water discharge line that has a fluidic connection to the water discharge pump and that is configured to guide washing water coming from the water discharge line to an outside of the laundry treatment apparatus. One end of the residual water discharge line may be connected to the discharge pump, and the other end of the residual water discharge line is capped by a faucet.

In some examples, the laundry treatment apparatus according to this aspect may further include a cabinet defining an external appearance of the laundry treatment apparatus, and a drawer housing retractably provided in the cabinet to be pushed in and withdrawn from the cabinet, the drawer housing being configured to accommodate the tub therein. The water discharge line may be in fluidic communication with the water supply connection pipe through a water discharge bracket mounted on a rear surface of the drawer housing. In some cases, the water discharge bracket may be in fluidic communication with the water supply connection pipe through a communication hose. The water supply connection pipe connected to the communication hose may include a check valve configured to prevent washing water supplied to the tub from flowing toward the water discharge bracket. The water supply connection pipe connected to the communication hose may include a check valve configured to prevent washing water discharged to an exterior of the tub from flowing toward the water supply connection pipe. In some cases, the water discharge line may include a first section extending in a width direction of the drawer housing from the water discharge pump, a second section extending in a height direction of the drawer housing from the first section, and a third section extending in the width direction of the drawer housing from the second section.

According to another aspect, a laundry treatment apparatus, which includes a main washing apparatus and a secondary washing apparatus for treating laundry, includes a cabinet defining an external appearance of the secondary washing apparatus, a drawer housing retractably provided in the cabinet and configured to be pushed in and withdrawn from the cabinet, a tub disposed in the drawer housing and configured to receive washing water, a drum rotatably disposed in the tub, a water supply unit configured to supply washing water to the tub, and a water discharge unit configured to discharge washing water from the tub. The water supply unit is in fluidic communication with the water discharge unit.

Implementations according to this aspect may include one or more of the following features. For example, the water supply unit may include a supply pipe configured to supply washing water to the tub, a water supply pipe extending into the tub, and a water supply connection pipe that provides a fluidic connection between the supply pipe and the water supply pipe. In these implementations, the water discharge unit may include a water discharge pump configured to discharge washing water in the tub, and a water discharge line that has a fluidic connection to the water discharge pump and that is configured to guide washing water in the tub to an exterior of the tub, and the water supply pipe may be in fluidic communication with the water discharge line.

In some examples, the supply pipe may include a cold water pipe configured to supply cold water to the tub and a hot water pipe for configured to supply hot water to the tub.

In these examples, the water supply pipe may provide a fluidic connection between the cold water pipe and the hot water pipe, and the water supply pipe may extend into the tub from the water supply connection pipe. In some cases, the water discharge line may be in fluidic communication with the water supply connection pipe through a water discharge bracket mounted on a rear surface of the drawer housing. The water discharge bracket may be in fluidic communication with the water supply connection pipe through a communication hose. The water supply connection pipe may include a check valve configured to prevent washing water supplied to the tub from flowing toward the water discharge bracket. The water supply connection pipe may include a check valve configured to prevent washing water discharged to an exterior of the tub from flowing toward the water supply connection pipe. The water discharge unit may further include a residual water discharge line that has a fluidic connection to the water discharge pump and that is configured to guide washing water coming from the water discharge line to an outside of the laundry treatment apparatus. One end of the residual water discharge line may be connected to the discharge pump, and the other end of the residual water discharge line may be capped by a faucet.

BRIEF DESCRIPTION OF THE DRAWINGS

FIG. 1 is a perspective view of an example laundry treatment apparatus;

FIG. 2 is a schematic cross-sectional view of the example laundry treatment apparatus shown in FIG. 2;

FIG. 3 is an exploded view of an example secondary washing apparatus;

FIG. 4 is a rear view of an example water discharge unit of the example secondary washing apparatus shown in FIG. 3;

FIG. 5 is a schematic perspective view of the example water discharge unit shown in FIG. 4;

FIG. 6 is a perspective view of an example water supply unit of the example secondary washing apparatus; and FIG. 7 is an enlarged view of the example water supply unit shown in FIG. 6.

DETAILED DESCRIPTION

FIGS. 1 and 2 illustrate an example laundry treatment apparatus according to an implementation of the present disclosure.

Referring to FIGS. 1 and 2, a laundry treatment apparatus 100 may include a main washing apparatus 200 and a secondary washing apparatus 300. The secondary washing apparatus 300 may be disposed beside or under the main washing apparatus 200. The main washing apparatus 200 may include a first cabinet 210 defining an external appearance thereof, and the secondary washing apparatus 300 may include a second cabinet 310 defining an external appearance thereof. The first cabinet 210 and the second cabinet 310 may be integrated with each other. In some cases, the laundry treatment apparatus may be include just one of the main washing apparatus 200 or the secondary washing apparatus 300.

The main washing apparatus 200 may be a front-loading washing apparatus. For example, a door 250 may be provided in the front of the main washing apparatus 200 so as to allow laundry to be introduced into the main washing apparatus 200 through the door 250.

As illustrated, the main washing apparatus 200 may include the first cabinet 210, defining the external appearance thereof, a first tub 220 disposed in the first cabinet 210 to receive and contain washing water, and a first drum 230 rotatably disposed in the first tub 220 to receive and contain laundry. The first drum 230 may be rotated in the first cabinet 210 by a first motor 240 disposed outside the first tub 220. In some cases, a first shaft 241 of the first motor 240 may extend through the rear surface of the first tub 220 and be connected to the rear surface of the first drum 230. Accordingly, the driving force of the first motor 240 may be transmitted to the first drum 230 through the first shaft 241.

In some cases, the first drum 230 may be provided on an inner surface thereof with at least one lifter 231, which is disposed in the first drum 230 and is capable of lifting laundry and then allowing the laundry to fall. A water supply unit 110 for supplying washing water to the first tub 220 and a second tub 320 of the secondary washing apparatus 300 may be provided, along with a water discharge unit 120 for discharging washing water discharged from the first tub 220 and the second tub 320 after completion of the laundry.

The water supply unit 110 may include a water supply pump and a supply line 111, and the water discharge unit 120 may include a water discharge pump and a water discharge pipe. The water supply unit 110 is connected to the supply line 111, through which washing water is supplied from a water source. The washing water supplied to the water supply unit 110 may be selectively supplied to the first tub 220 along a first line 112 through a detergent container 260, or to a second tub 320 along a second line 113. In order to supply washing water to the first tub 220 or the second tub 320 in a selective manner, the first line 112 and the second line 113 may be provided with a first valve 114 and a second valve 115, respectively. In this way, the first valve 114 may open and shut off the first line 112, and the second valve may open and shut off the second line 113.

A damper 270 may be disposed between the first cabinet 210 and the first tub 220 so as to absorb vibrations transmitted to the first tub 220 due to rotation of the first drum 230. Furthermore, a damper (for example, a cylinder damper) may be disposed between the first tub 220 and the cabinet of the secondary washing apparatus 300. The damper may include a spring damper or a cylinder damper, among others. A control panel 280 for controlling the main washing apparatus 200 may be provided on the upper front area of the first cabinet 210.

The secondary washing apparatus 300 may be disposed close to the main washing apparatus 200. For example, to improve a user's convenience in using the main washing apparatus 200, the secondary washing apparatus 300 may be disposed under the main washing apparatus 200. In other words, the secondary washing apparatus 300 may raise the installation position of the main washing apparatus 200 to be at a more convenient height for the user.

When both the main washing apparatus 200 and the secondary washing apparatus 300 are provided together, the main washing apparatus 200 and the secondary washing apparatus 300 may be configured to have the same washing capacity. However, in consideration of restricted installation space of the laundry treatment apparatus 100 and manufacturing cost of the laundry treatment apparatus 100, one of the main washing apparatus 200 or the secondary washing apparatus 300 may be configured to have a larger capacity than the other.

In one implementation, the secondary washing apparatus 300 may be configured to be smaller than the main washing apparatus 200 in at least one of washing capacity, volume and height, as shown in FIGS. 1 and 2. Therefore, a user may appropriately select to use either the main washing apparatus 200 or the secondary washing apparatus 300 based on the amount of laundry to be washed.

A user may select and use one of the main washing apparatus 200 and the secondary washing apparatus 300 in accordance with the type of laundry. For example, babies' wear, underwear or the like, which may require separate washing, may be washed using the secondary washing apparatus 300, and other laundry may be washed using the main washing apparatus 200.

As illustrated, the secondary washing apparatus 300 is a top-loading type washing apparatus. Furthermore, the secondary washing apparatus 300 may be constructed as a drawer type, which may be pushed in or withdrawn from the second cabinet 310. For example, the secondary washing apparatus 300 may include the second cabinet 310, defining the external appearance thereof, a drawer housing 360, which may be pushed in or withdrawn from the second cabinet 310, the second tub 320, disposed in the drawer housing 360 to contain washing water, and a second drum 330, rotatably disposed in the second tub 320 to contain laundry therein. A water discharge unit 400, which is intended to discharge washing water contained in the second tub 320 to the outside of the secondary washing apparatus 300, may be disposed beside the second tub 320.

The drawer housing 360 may be pushed into or withdrawn from the second cabinet 310 through an opening 350 formed in the second cabinet 310 and facing the forward direction of the laundry treatment apparatus 100.

The second drum 330 may be rotated in the drawer housing 360 by a second motor 340 disposed outside the second tub 320. In some cases, a second shaft 341 of the second motor 340 may extend through the bottom surface of the second tub 320 and be connected to the bottom surface of the second drum 330. Consequently, the driving force of the second motor 340 may be transmitted to the second drum 330 through the second shaft 341.

The drawer housing 360 may be provided at a front surface thereof with a cover panel 361. The cover panel 361 may be integrated with the drawer housing 360. The cover panel 361 may further be provided with a handle 362 so as to enable the drawer housing 360 to be pushed in or withdrawn, and may further be provided at an upper surface thereof with a control panel 380 for controlling the secondary washing apparatus 300. The drawer housing 360 may be provided at an upper portion thereof with a washing water supply hole 365 for allowing washing water to be supplied to the second tub 320, and may be provided with a door 363 for allowing laundry to be put into or taken out of the second drum 330. The door 363 may be provided with a cover handle 364 for enabling the door 363 to be pulled and opened by a user.

Hereinafter, the secondary washing apparatus according to the implementation of the present disclosure will be described in more detail with reference to FIG. 3.

Referring to FIG. 3, the secondary washing apparatus 300 according to one implementation includes the drawer housing 360, opening at an upper surface thereof, and a drawer cover 366, provided at the open upper surface of the drawer housing 360.

The drawer housing 360 may be configured to have a hexahedral shape having a hollow cavity. The drawer cover 366 may be secured to the drawer housing 360 to define the upper surface of the drawer housing 360.

The drawer housing 360 may be provided at the front surface thereof with the cover panel 361. The cover panel 361 may include the handle 362 formed at the front surface thereof. A user may withdraw the drawer housing 360 from the second cabinet 310 using the handle 362.

The cover panel 361 may be provided at the upper surface thereof with the control panel 380 for controlling the secondary washing apparatus 300. The control panel 380 is configured to allow a user to input control commands for controlling a unit for supplying washing water to a laundry-containing compartment in the secondary washing apparatus 300 and for discharging the washing water therefrom, a unit for rotating clothing, a unit for supplying steam or hot air to clothing and the like. The control panel 380 may also be used as a unit for checking control commands input by a user and for notifying a user of the state of execution of the control commands input by the user.

The drawer cover 366 may define an introduction port 367, which is formed through the drawer cover 366 to allow the inside of the drawer housing 360 to communicate with the outside of the drawer housing 360, and may be provided with the washing water supply hole 365, which is formed through the drawer cover 366 to guide washing water into the secondary washing apparatus 300 (i.e. the second tub 320).

The drawer housing 360 may be provided therein with the second tub 320 defining a space for containing washing water, and the second drum 330 may be rotatably disposed in the second tub 320 to contain laundry.

The second tub 320 may include a tub body 321, which defines a space for containing washing water and opens at the upper surface thereof, and a tub cover 322 mounted on the upper surface of the tub body 321.

The second drum 330 may be rotated in the tub body 321 by means of a driving unit provided outside the tub body 321. The driving unit may include the second motor 340 installed outside the tub body 321 and the second shaft 341 for transmitting driving force of the second motor 340 to the second drum 330 (see FIG. 2). Here, the second motor 340 may include a stator, secured to the tub body 321 to generate a rotating magnetic field, and a rotor that can be rotated by the rotating magnetic field.

The tub body 321 may be installed in the drawer housing 360 by means of tub supports D. The tub supports D can help prevent vibrations caused by rotation of the second drum 330 from being transmitted to the second cabinet 310 through the second tub 320. Specifically, the tub supports D can serve to support the second tub 320 so as to cause the second tub 320 to float from the bottom of the second cabinet 310 and to absorb vibrations of the second tub 320.

The drawer housing 360 may be provided with first brackets 368 configured to support upper ends of the tub supports D, and the tub body 321 may be provided at an outer surface thereof with second brackets 328 configured to support lower ends of the tub supports D.

The first brackets 368 may project toward the center of the drawer housing 360 from the inner surface of the drawer housing 360, and the second brackets 328 may project toward the inner surface of the drawer housing 360 from the outer surface of the tub body 321.

The tub cover 322 may define a tub introduction port 323, which is formed through the tub cover 322 to allow the introduction port 367 to communicate with the inside of the second drum 330. The tub cover 322 may further define a through hole 324, which is disposed under the washing water supply hole 365 to guide washing water, which has been introduced through the washing water supply hole 365, to the drum 330.

The tub introduction port 323 may be provided with the door 363. The door 363 may be hingedly provided at the tub cover 322. The door 363 may be coupled to the tub cover 322 by means of a hinge. In some cases, the introduction port 367 may be positioned above the tub introduction port 323, and the door 363 and the tub introduction port 323 may be configured to be smaller than the introduction port 367. Accordingly, even though the tub introduction port 323 is positioned under the drawer cover 366, the tub introduction port 323 may be opened and closed by the door 363.

In more detail, the tub introduction port 323 cannot be opened when the door 363 interferes with the introduction port 367 due to geometric tolerance or positional tolerance. In order to address this problem, the outer surface of the door 363 may be spaced apart from the inner surface of the introduction port 367 by a predetermined distance.

The door 363 may be provided with a handle 364 for releasably retaining the door 363 on the drawer cover 366 or the tub cover 322. The door 363 may further be provided with a sealing portion for preventing the leakage of washing water through the tub introduction port 323. The sealing portion may be made of any material that can help seal the tub introduction port 323 when the tub introduction port 323 is closed. By way of example, the sealing portion may include an elastic body such as rubber.

Hereinafter, the water discharge unit of the laundry treatment apparatus (i.e. the secondary washing apparatus) according to an implementation of the present disclosure will be described with reference to FIGS. 4 and 5.

FIG. 4 shows the water discharge unit 400 provided on the rear surface of the drawer housing 360 of the secondary washing apparatus. FIG. 5 illustrates the water discharge unit 400 shown in FIG. 4. FIGS. 4 and 5 illustrate only the water discharge unit, not the water supply unit; the water supply unit will be separately described below with reference to FIGS. 6 and 7.

Referring to FIGS. 4 and 5, the water discharge unit 400 of the laundry treatment apparatus includes a water discharge pump 410 for supplying power required to discharge washing water from the second tub 320, and a water discharge line 420 connected to the water discharge pump 410 to guide washing water in the second tub 320 toward the outside of the second tub 320. Specifically, the water discharge unit 400 may be installed on the rear surface of the drawer housing 360. For example, in order to discharge washing water from the second tub 320 toward the outside of the second cabinet 310, the water discharge pump 410 may be provided on the rear surface of the drawer housing 360. Specifically, the water discharge pump 410 may be disposed at the lower left or lower right area of the rear surface of the drawer housing 360. One end of the water discharge line 420 may communicate with the water discharge pump 410, and the other end of the water discharge line 420 may communicate with a sewage line or the like disposed outside of the second cabinet 310.

The water discharge line 420 may be configured to have a "C" shape. For example, the water discharge line 420 may include a first line 421 extending in the width direction of the drawer housing 360 from the water discharge pump 410, a second line 422 extending in the height direction of the drawer housing 360 from the end of the first line 421, and a third line 423 communicating with the second line 422 and extending in the width direction of the drawer housing 360 from the end of the second line 422. The first line 421, the second line 422 and the third line 423 may be integrated with one another.

The end of the third line 423 may be secured to the rear surface of the drawer housing 360 by means of a water discharge bracket 424. For example, the water discharge bracket 424 may be disposed at the upper left or upper right area of the rear surface of the drawer housing 360, and the end of the line 423 may be connected to the water discharge bracket 424. The water discharge bracket 424 may include a water discharge hole 425 defined therein, so that washing water flowing from the end of the third line 423 can be discharged to the outside of the second cabinet 310 through the water discharge hole 425 in the water discharge bracket 424.

In some cases, the water discharge hole 425 may be connected to a water discharge guide pipe that is adapted to guide washing water toward a sewage line disposed outside of the second cabinet 310.

When washing water in the second tub 320 is discharged after completion of a washing or rinsing procedure, the washing water may flow through the water discharge pump 410, the first line 421, the second line 422, the third line 423, the water discharge hole 425 of the water discharge bracket 424 and the water discharge guide pipe, in this order, and may then be discharged to the outside of the second cabinet 310.

FIG. 5 is illustrates the water discharge unit 400 of the laundry treatment apparatus (i.e. the secondary washing apparatus).

Referring to FIG. 5, the water discharge unit 400 may further include a residual water discharge line 430.

In some cases, when the operation of the water discharge pump 410 to discharge washing water from the second tub 320 is halted, washing water may remain in the water discharge line 420. Specifically, one of the second line 422 and the third line 423 may communicate with the inside of the second tub 320. When the operation of the water discharge pump 410 is halted, the introduction of air in the second tub 320 into one the second line 422 and the third line 423 may reduce or block the siphon phenomenon. In this case, washing water may remain in the first line 421, which is disposed at a level lower than the second line 422 and the third line 423.

When washing water remains in the first line 421, it is possible to prevent a foul smell that may be generated from a sewage line from being introduced into the second tub 320 through the water discharge line 420. However, the first line 421 may become frozen under low ambient temperatures and thus rupturing due to washing water remaining therein, for instance during the winter season. Accordingly, washing water in the first line 421 should be able to be discharged as needed. To this end, the laundry treatment apparatus according to the implementation of the present disclosure may include a residual water discharge line 430.

As shown in FIG. 5, one end 431 of the residual water discharge line 430 may be connected to the water discharge pump 410, and the other end 432 of the residual water discharge line 430, which serves as the free end, may be detachably mounted on the front area of a side surface of the drawer housing 360. For example, the residual water discharge line 430 may be disposed in such a manner as to extend in the forward direction of the drawer housing 360 along the side surface of the drawer housing 360 from the water discharge pump 410, installed at the rear surface of the drawer housing 360.

During normal operation, the other end 432 of the residual water discharge line 430 should be disposed at a level higher than the first line 421 in order to maintain the residual water in the first line 421. Referring to FIG. 5, the other end 432 of the residual water discharge line 430 is disposed at a level higher than the first line 421, and is pointed upward.

The other end 432 of the residual water discharge line 430 may be disposed such that it is exposed to the outside of the second cabinet 310 when the drawer housing 360 is withdrawn from the second cabinet 310.

The drawer housing 360 may be provided at a side surface thereof with a guide bracket 433 that is adapted to guide the residual water discharge line 430. The drawer housing 360 may further be provided at a front area of the side surface thereof with a holding bracket 434 for releasably holding the other end 432 of the residual water discharge line 430.

The first line 421 may be disposed to be downwardly inclined toward the proximal end from the distal end thereof with respect to the water discharge pump 410. The first line 421 and the residual water discharge line 430 may communicate with each other via the water discharge pump 410.

Accordingly, when a user intends to discharge the washing water remaining in the first line 421, the user will first withdraw the drawer housing 360 from the second cabinet 310, and will then separate the other free end of the residual water discharge line 430 from the side surface of the drawer housing 360. Subsequently, when the separate other end 432 is inclined downward by a user, washing water remaining in the first line 421 may be discharged to the outside of the second cabinet 310 through the water discharge pump 410 along the residual water discharge line 430.

In some cases, an opening and closing faucet 435 may be provided at the other end of the residual water discharge line 430. Accordingly, in order for a user to discharge washing water remaining in the first line 421 and the water discharge pump 410 to the outside of the second cabinet 310 through the residual water discharge line 430, the faucet 435 may be opened.

Referring to back to FIG. 4, the laundry treatment apparatus may include washing water supply members 501 and 502 for allowing washing water (at least one of cold water and hot water) to be supplied to the second tub 320. Washing water may be supplied to the second tub 320 from an external water source. The external water source and the washing water supply members 501 and 502 may be connected to each other via supply hoses. The structure for supplying washing water will now be described in detail with reference to FIGS. 6 and 7.

FIG. 6 illustrates an example water supply unit of the secondary washing apparatus according to the implementation of the present disclosure. Although only the water supply unit is illustrated in FIG. 6, the water discharge unit described in FIGS. 4 and 5 may be applied to the secondary washing apparatus shown in FIG. 6.

Referring to FIG. 6, the laundry treatment apparatus (the secondary washing apparatus) according to the implementation of the present disclosure may further include a water supply unit 500 and a softener supply unit 600.

The water supply unit 500 may include supply pipes 511 and 512 for supplying washing water to the second tub 320, a water supply pipe 530 extending toward the inside of the second tub 320, and a water supply connection pipe 520 connecting the supply pipes 511 and 512 to the water supply pipe 530.

More specifically, the supply pipes 511 and 512 of the water supply unit 500 may include a hot water supply pipe 511 for supplying hot water to the second tub 320 and a cold water supply pipe 512 for supplying cold water to the second tub 320. The water supply connection pipe 520 may be configured to connect the hot water supply pipe 511 to the cold water supply pipe 512.

The water supply pipe 530 may be configured to extend toward the inside of the second tub 320 from the water supply connection pipe 520.

Therefore, at least one of hot water and cold water, which have been supplied to the water supply connection pipe 520 through at least one of the hot water pipe 511 and the cold water pipe 512, may be supplied to the inside of the second tub 320 through the water supply pipe 530.

The hot water and cold water may be supplied from a water source disposed outside or inside the second cabinet 310.

The water supply pipe 530 may be disposed on the drawer housing 360. The water supply pipe 530 may be disposed to be downwardly inclined toward the inside of the second tub 320 from the water supply connection pipe 520.

The end of the water supply pipe 530 that extends toward the inside of the second tub 320 from the water supply connection pipe 520 may be connected to the washing water supply hole 365, formed in the upper surface of the drawer housing 360, so as to supply washing water to the inside of the second tub 320. The water supply pipe 530 may be disposed to be downwardly inclined toward the washing water supply hole 365 formed in the upper surface of the drawer housing 360 from the water supply connection pipe 520.

A connection bracket 513 may be provided outside the drawer housing 360. For example, the connection bracket 513 may be disposed above the rear portion of the drawer housing 360. The water supply connection pipe 520 and the softener supply pipe 620 may be mounted on the connection bracket 513.

When the drawer housing 360 is pushed into or withdrawn from the second cabinet 310, there may be a risk of the water supply pipe 530 and the softener supply pipe 630 becoming twisted or broken.

In order to prevent or mitigate such risk, the laundry treatment apparatus (the secondary washing apparatus) according to the implementation of the present disclosure may further include a guide 540 for guiding at least one of the water supply pipe 530 and the second softener supply pipe 630 and a guide rail 550 for guiding the end of the guide 540.

Referring to FIG. 6, the guide 540 may be disposed on the drawer housing 360, and may extend in the width direction of the drawer housing 360. For example, the guide 540 may be disposed on the upper surface of the drawer housing 360, and may extend in the width direction of the drawer housing 360.

The guide 540 may be configured to surround at least a portion of the water supply pipe 530 and the second softener supply pipe 630, and may include at least one holding protrusion 541 for holding the water supply pipe 530 and the second softener supply pipe 630.

The holding protrusion 541 may be configured to prevent the water supply pipe 530 and the second softener supply pipe 630 from being lifted and separated.

The guide rail 550 may be installed at a side surface above the drawer housing 360 to be opposite to the connection bracket 513. For example, the guide rail 550 may be installed at a side surface opposite to the connection bracket 513 in the width direction of the drawer housing 360.

When the drawer housing 360 is withdrawn from the second cabinet 310, the guide rail 550 serves to guide the end of the guide 540 in the forward direction of the drawer housing 360.

In some cases, one end of the guide 540 may be rotatably connected to the connection bracket 513 provided above the drawer housing 360. Accordingly, when the drawer housing 360 is pushed into the second cabinet 310, the other end of the guide 540 may be disposed on one end of the guide rail 550. When the drawer housing 360 is withdrawn from the second cabinet 310, the other end of the guide 540 may move to the other end of the guide rail 550 along the guide rail 550.

When the drawer housing 360, which has been withdrawn from the second cabinet 310, is again pushed into the second cabinet 310, the other end of the guide 540 may, of course, move to the one end of the guide rail 550 along the guide rail 550.

The other end of the guide 540 may be provided with a guide bracket 542. The water supply pipe 530 and the second softener supply pipe 630 may be bent at the guide bracket 542, and may extend toward the washing water supply hole 365 and the softener supply hole 369, respectively. The connection between the guide 540 and the guide rail 550 may be implemented by the guide bracket 542. The guide 540 and the guide bracket 542 may be integrally formed with each other.

Accordingly, when the drawer housing 360 is withdrawn from the second cabinet 310, the guide bracket 542, which is provided at the other end of the guide 540, may move to the other end from the one end of the guide rail 550 along the guide rail 550. When the drawer housing 360 is pushed into the second cabinet 310, the guide bracket 542 may move to the one end from the other end of the guide rail 550 along the guide rail 550.

In order to guide the guide 540 in this way, the guide rail 550 may be curved to have a predetermined radius of curvature. The one end as well as the other end of the guide rail 550 may be secured above the drawer housing 360.

For example, the one end of the guide rail 550 may be disposed above the rear end of the drawer housing 360, and the other end of the guide rail 550 may be disposed above the front end of the drawer housing 360.

Specifically, the one end of the guide rail 550 may be disposed at one side surface in the width direction of the drawer housing 360, and the other end of the guide rail 550 may be disposed at the center in the width direction of the drawer housing 360.

Washing water remaining in the water supply pipe 530 or softener remaining in the second softener supply pipe 630 may cause the water supply pipe 530 and the second softener supply pipe 630 to be frozen and thus rupture during the winter season, during which the ambient temperature can be low.

When washing water in the second tub 320 is discharged, the washing water in the water discharge line 420 may be completely discharged to the outside of the water discharge line 420 by the siphon phenomenon.

This may be advantageous in that washing water does not remain in the water discharge line 420 and the second tub 320 due to the siphon phenomenon. However, foul smell from a wastewater line may be introduced into the second tub 320 through the water discharge line 420. Furthermore, there is a risk that washing water introduced into the second tub 320 may also be discharged when washing water is supplied to the second tub 320 before the washing water is completely discharged.

The structure of the water supply unit 500 and the water discharge unit for solving the problem will now be described in detail with reference to FIGS. 6 and 7.

FIG. 7 is an enlarged view showing the water supply unit shown in FIG. 6. Referring to FIGS. 6 and 7, the laundry treatment apparatus (i.e. the secondary washing apparatus) according to the implementation of the present disclosure may be constructed such that the water supply unit 500 communicates with the water discharge unit 400.

Accordingly, since the atmospheric pressure may be applied to the water supply unit 500 through the water discharge unit 400 when washing water is supplied to the second tub 320 through the water supply unit 500, it can be possible to prevent washing water from remaining in the water supply unit 500.

In other words, even if the operation of water supply by an external motor or pump is halted, the washing water in the water supply unit 500 may be supplied to the second tub 320 through the washing water supply hole 365 by the atmospheric pressure applied through the water discharge unit 400. Therefore, it may be possible to prevent the water supply unit 500 from being frozen and thus rupturing due to washing water remaining in the water supply unit 500 in the winter season.

For this reason, the supply time of washing water through the water supply unit 500 should be controlled so as not to overlap the time of discharge of washing water, at least for a predetermined period of time.

For example, a portion of the water supply connection pipe 520 may communicate with the water discharge unit 400. The water supply connection pipe 520 may communicate with the water discharge unit 400 through a communication hose 600.

In some cases, a portion of the water supply connection pipe 520 may communicate with the water discharge line 420 through the communication hose 600. More specifically, a portion of the water supply connection pipe 520 may communicate with the third line 423, which is disposed at the highest level among the lines of the water discharge line 420, through the communication hose 600.

The end of the third line 423, which is disposed at the highest level among the lines of the water discharge line 420, may be secured to the rear surface of the drawer housing 360 by means of the water discharge bracket 424 (see FIGS. 4 and 5). The water discharge line 420 may communicate with the water supply connection pipe 520 through the water discharge bracket 424 secured to the rear surface of the drawer housing 360. Here, the communication hose 600 enables the water discharge bracket 424 to communicate with the water supply connection pipe 520.

Since the water supply unit 500 may communicate with the water discharge unit 400 by means of the above-described structure, it is possible to prevent freezing and rupture of the water supply unit 500 due to washing water remaining in the water supply unit 500.

The water supply connection pipe 520 may include a communication protrusion 522, which communicates with an end of the third line 423 through the communication hose 600. The water supply connection pipe 520 may further include a water supply protrusion 521, which is connected to the water supply pipe 530.

Accordingly, when washing water remains in the water supply pipe 530, since the atmospheric pressure is applied to the water supply pipe 530 through the water discharge line 420 (for example, the third line 423) communicating with the inside of the second tub 320 and the communication hose 600, the washing water in the water supply pipe 530 may be introduced into the second tub 320 without remaining in the water supply pipe 530.

The construction in which the water supply pipe 530 is inclined downward toward the inside of the second tub 320 from the water supply connection pipe 520 can help introduce washing water in the water supply pipe 530 into the second tub 320.

With the communication between the water supply unit 500 and the water discharge unit 400 (that is, the communication between the water supply connection pipe 520 and the water discharge bracket 424), it may be possible to prevent or mitigate the water supply pipe 530 from being frozen and thus rupturing in the winter season during which the ambient temperature is low because washing water does not remain in the water supply pipe 530.

In some cases, when a softener supply line is additionally provided, the water supply connection pipe 520 may be connected to the softener supply line. For instance, in order to cause the washing water remaining in the water supply pipe 530 to flow into the second tub 320, the water supply connection pipe 520 may communicate with the softener supply line. Using this structure, it may be possible to obtain the similar effects as that obtained by communication between the water supply connection pipe 520 and the water discharge bracket 424.

The water supply connection pipe 520, which is connected to the communication hose 600, may be provided with a check valve for preventing washing water supplied to the second tub 320 from flowing toward the water discharge unit 400 (for example, the water discharge bracket 424). In some instances, the check valve provided at the water supply connection pipe 520 may be provided at the region at which the water supply connection pipe 520 is connected to the communication hose 600.

The water discharge unit 400 (for example, the water discharge bracket 424) connected to the communication hose 600 may be provided with a check valve for preventing washing water discharged to the outside of the second tub 320 from flowing toward the water supply connection pipe 520. For instance, the check valve provided at the water discharge bracket 424 may be provided at the region at which the water discharge bracket 424 is connected to the communication hose 600.

The communication hose 600 may, of course, be directly connected to the third line 423 of the water discharge line 420. In this case, the check valve may also be provided at the region where the communication hose 600 is connected to the third line 423.

The structure in which the water supply unit 500 communicates with the water discharge unit 400 may serve to block or reduce the siphon phenomenon which may occur at the water discharge unit 400 at the time of discharge of washing water in the second tub 320.

For example, when the water discharge pump 410 is activated so as to discharge washing water in the second tub 320, the washing water in the second tub 320 may be discharged by the siphon phenomenon.

The occurrence of the siphon phenomenon can be advantageous in that washing water may be completely discharged without remaining in the second tub 320 or the water discharge line 420. However, when the washing water in the water discharge line 420 is completely discharged, foul smell generated from a wastewater line may be introduced into the second tub 320 through the water discharge line 420. When washing water is supplied to the second tub 320 before the completion of discharge of washing water, there may also be a problem in that washing water introduced into the second tub 320 may also be discharged.

In this case, the structure in which the water supply unit 500 communicates with the water discharge unit 400 may block the occurrence of the siphon phenomenon at the water discharge line 420.

For instance, in order to block the siphon phenomenon, which may occur at the water discharge line 420 (that is, in order to prevent washing water supplied to the second tub 320 from being discharged to the outside of the second tub 320 through the water discharge line 420 even when the water discharge pump 410 is not activated), the water discharge hole 425 should be positioned at a level higher than the maximum level of washing water contained in the second tub 320.

For example, when the operation of the water discharge pump 410 is halted, the air in the second tub 320 may be introduced into the water discharge line 420 through the communication hose 600, thus blocking the siphon phenomenon. Therefore, some of the washing water in the water discharge line 420, which is present at a position lower than the level at which the communication hose 600 is connected to the water discharge line 420 or the water discharge bracket 424, will remain in the water discharge line 420. Washing water normally remains in the first line 421 of the water discharge line 420.

When washing water remains in the water discharge line 420, it may be possible to prevent the foul smell from a wastewater line from being introduced into the second tub 320 through the water discharge line 420. In this case, to mitigate the risk of freezing and rupture of the water discharge line 420 in the winter season, washing water remaining in the water discharge line 420 may be completely discharged to the outside of the laundry treatment apparatus through the residual water discharge line 430 in the winter season. In order to discharge residual water in the residual water discharge line 430, a user can withdraw the drawer housing 360 from the second cabinet 310.

As described above, the present disclosure provides an additional laundry treatment apparatus (i.e. a secondary washing apparatus), which is removably provided at a laundry treatment apparatus (i.e. a main washing apparatus) to execute washing and drying of laundry.

Furthermore, the present disclosure provides a laundry treatment apparatus that makes it easy to supply and discharge washing water to and from a laundry container removably provided in a cabinet.

In addition, the present disclosure provides a laundry treatment apparatus capable of preventing washing water from remaining in a water supply line for supplying washing water to a laundry container.

Furthermore, the present disclosure provides a laundry treatment apparatus capable of preventing softener from remaining in a softener supply pipe adapted to supply softener to a container of the laundry treatment apparatus.

It will be apparent to those skilled in the art that various modifications and variations can be made without departing from the spirit or scope of the disclosure. Thus, it is intended that the present disclosure covers modifications and variations provided they come within the scope of the appended claims and their equivalents.

What is claimed is:

1. A laundry treatment apparatus comprising:

a tub configured to receive washing water;

a drum rotatably disposed in the tub;

a water supply unit configured to supply washing water to the tub; and a water discharge unit configured to discharge washing water from the tub, wherein the water supply unit comprises a water supply pipe extending to the tub and disposed vertically higher than the tub, with at least a portion of the water supply pipe extending along a rear upper edge of the tub, wherein the water discharge unit comprises:

a water discharge pump configured to discharge washing water from the tub, and a water discharge line extending from the water discharge pump to a level vertically higher than the tub, the water discharge line being configured to discharge washing water in the tub, and wherein the water supply unit and the water discharge line are configured to communicate with each other at a position that is vertically higher than the tub to cause at least a portion of the washing water that remains in the water supply pipe to flow into the tub.

2. The laundry treatment apparatus according to claim 1, wherein the water supply unit comprises:

a main supply pipe configured to supply washing water to the tub; and a water supply connection pipe connecting the main supply pipe to the water supply pipe, wherein the water supply connection pipe is connected to the water discharge unit.

3. The laundry treatment apparatus according to claim 2, wherein the main supply pipe includes a cold water pipe configured to supply cold water to the tub and a hot water pipe configured to supply hot water to the tub, wherein the water supply pipe provides a fluidic connection between the cold water pipe and the hot water pipe, and wherein the water supply pipe extends into the tub from the water supply connection pipe.

4. The laundry treatment apparatus according to claim 2, wherein the water supply connection pipe is connected to the water discharge line.

5. The laundry treatment apparatus according to claim 4, further comprising:

a cabinet defining an external appearance of the laundry treatment apparatus; and a drawer housing retractably provided in the cabinet to be pushed in and withdrawn from the cabinet, the drawer housing being configured to accommodate the tub therein, wherein the water discharge line is in fluidic communication with the water supply connection pipe through a water discharge bracket mounted on a rear surface of the drawer housing.

6. The laundry treatment apparatus according to claim 5, wherein the water discharge bracket is in fluidic communication with the water supply connection pipe through a communication hose.

7. The laundry treatment apparatus according to claim 6, wherein the water supply connection pipe connected to the communication hose includes a check valve configured to prevent washing water supplied to the tub from flowing toward the water discharge bracket.

8. The laundry treatment apparatus according to claim 6, wherein the water supply connection pipe connected to the communication hose includes a check valve configured to prevent washing water discharged to an exterior of the tub from flowing toward the water supply connection pipe.

9. The laundry treatment apparatus according to claim 5, wherein the water discharge line comprises:

a first section extending in a width direction of the drawer housing from the water discharge pump;

a second section extending in a height direction of the drawer housing from the first section; and a third section extending in the width direction of the drawer housing from the second section.

10. The laundry treatment apparatus according to claim 4, wherein the water discharge unit further comprises a residual water discharge line that has a fluidic connection to the water discharge pump and that is configured to guide washing water coming from the water discharge line to an outside of the laundry treatment apparatus.

11. The laundry treatment apparatus according to claim 10, wherein one end of the residual water discharge line is connected to the discharge pump, and the other end of the residual water discharge line is capped by a faucet.

12. A laundry treatment apparatus including a main washing apparatus and a secondary washing apparatus for treating laundry, the secondary washing apparatus comprising:

a cabinet defining an external appearance of the secondary washing apparatus;

a drawer housing retractably provided in the cabinet and configured to be pushed in and withdrawn from the cabinet;

a tub disposed in the drawer housing and configured to receive washing water;

a drum rotatably disposed in the tub;

a water supply unit configured to supply washing water to the tub; and a water discharge unit configured to discharge washing water from the tub, wherein the water supply unit comprises a water supply pipe extending to the tub and disposed vertically higher than the tub, with at least a portion of the water supply pipe extending along a rear upper edge of the tub, wherein the water discharge unit comprises:

a water discharge pump configured to discharge washing water from the tub, and a water discharge line extending from the water discharge pump to a level higher than the drawer housing, the water discharge line being configured to discharge washing water in the tub, and wherein the water supply unit and the water discharge line are configured to communicate with each other at a position that is vertically higher than the drawer housing to cause at least a portion of the washing water that remains in the water supply pipe to flow into the tub.

13. The laundry treatment apparatus according to claim 12, wherein the water supply unit includes:

a main supply pipe configured to supply washing water to the tub, and a water supply connection pipe connecting the main supply pipe to the water supply pipe, and wherein the water supply pipe is in fluidic communication with the water discharge line.

14. The laundry treatment apparatus according to claim 13, wherein the main supply pipe includes a cold water pipe configured to supply cold water to the tub and a hot water pipe for configured to supply hot water to the tub, wherein the water supply pipe provides a fluidic connection between the cold water pipe and the hot water pipe, and wherein the water supply pipe extends into the tub from the water supply connection pipe.

15. The laundry treatment apparatus according to claim 13, wherein the water discharge line is in fluidic communication with the water supply connection pipe through a water discharge bracket mounted on a rear surface of the drawer housing.

16. The laundry treatment apparatus according to claim 15, wherein the water discharge bracket is in fluidic communication with the water supply connection pipe through a communication hose.

17. The laundry treatment apparatus according to claim 15, wherein the water supply connection pipe includes a check valve configured to prevent washing water supplied to the tub from flowing toward the water discharge bracket.

18. The laundry treatment apparatus according to claim 15, wherein the water supply connection pipe includes a check valve configured to prevent washing water discharged to an exterior of the tub from flowing toward the water supply connection pipe.

19. The laundry treatment apparatus according to claim 13, wherein the water discharge unit further comprises a residual water discharge line that has a fluidic connection to the water discharge pump and that is configured to guide washing water coming from the water discharge line to an outside of the laundry treatment apparatus.

20. The laundry treatment apparatus according to claim 19, wherein one end of the residual water discharge line is connected to the discharge pump, and the other end of the residual water discharge line is capped by a faucet.

* * * * *